US005860179A

United States Patent [19]

Shipman

[11] Patent Number: 5,860,179

[45] Date of Patent: Jan. 19, 1999

[54] BRUSH APPARATUS

[76] Inventor: Duane G. Shipman, 1209 Smiling Hill Blvd., Edmond, Okla. 73034

[21] Appl. No.: 803,736

[22] Filed: Feb. 21, 1997

[51] Int. Cl.[6] ..... B08B 1/04

[52] U.S. Cl. ..... 15/88; 15/88.3; 15/104.04

[58] Field of Search ..... 15/21.1, 88, 88.2, 15/88.3, 104.04

[56] References Cited

U.S. PATENT DOCUMENTS

| | | | |
|---|---|---|---|
| 1,020,789 | 3/1912 | Armstrong | 15/88 |
| 1,692,985 | 11/1928 | Gallison | 15/88 X |
| 2,260,783 | 10/1941 | Morley | 15/88 |
| 2,353,125 | 7/1944 | Carpmail | 15/88 |
| 2,359,568 | 10/1944 | Logan | 15/88 X |
| 3,067,443 | 12/1962 | Romens et al. | 15/21.1 |
| 3,274,630 | 9/1966 | Mileikowsky et al. | 15/88.3 |
| 3,435,479 | 4/1969 | Gibson, Sr. | 15/104.04 |
| 4,151,625 | 5/1979 | Stevanovich | 15/88 X |
| 4,433,448 | 2/1984 | True | 15/88 |
| 4,554,696 | 11/1985 | Nye, Jr. | 15/104.04 |
| 5,005,244 | 4/1991 | Muraguchi | 15/88 |
| 5,099,537 | 3/1992 | Denny | 15/88 |

FOREIGN PATENT DOCUMENTS

| | | | |
|---|---|---|---|
| 465834 | 1/1969 | Switzerland | 15/88 |

*Primary Examiner*—Mark Spisich
*Attorney, Agent, or Firm*—Dunlap, Codding & Rogers, P.C.

[57] ABSTRACT

An apparatus and method for cleaning cylindrical objects such as bolts and pipes is provided. The apparatus includes a support frame to which at least three shafts are rotatably mounted. Each shaft is provided with a circular brush secured to a portion thereof such that the brushes are arranged in a coplanar relationship and spaced apart to define an object receiving passage wherein each of the brushes engages the object when the object is disposed in the object receiving passage. The brushes are caused to be rotated in the same direction but with one of the brushes rotating at a different rate than the other brushes so that the object is caused to rotate in response to the rotation of the brushes.

7 Claims, 4 Drawing Sheets

BRUSH APPARATUS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates generally to cleaning devices, and more particularly, but not by way of limitation, to an improved brush apparatus for cleaning the outer surface of cylindrical objects, such as pipes and bolts.

2. Brief Description of the Related Art

Various kinds of nuts and bolts are used for fastening together various parts of machines and structures. In the maintenance of such machines and structures, the bolts are often removed for inspection. Prior to reinstallation of the bolts, the threads are typically cleaned to remove any foreign matter, such as rust and corrosion, that may have accumulated on the bolts.

In many instances, bolts are cleaned by manually holding the bolt and bringing the bolt into contact with a single rotating wire brush. After initially bringing the bolt into contact with the brush, the bolt must be repeatedly rotated by the individual to clean the entire bolt. It has been appreciated that cleaning bolts in such a manner is tedious, laborious, and time consuming, and furthermore, can result in serious injury to the person handling the bolts.

Thus, several cleaning devices have previously been proposed in an attempt to overcome the problems associated with cleaning bolts, as well as other cylindrical objects, such as pipes. One such device is disclosed in U.S. Pat. No. 4,433,448, issued to True. The True device is a hand held device that includes a plurality of brushes mounted to a rotating disc. The brushes and the disc are encompassed in a housing that is provided with a handle. In use, the device is disposed over the end of the tubular member to be cleaned such that the tubular member is positioned between the brushes. A motor is actuated to cause the brushes to be rotated about the tubular member. It will be appreciated that the True device must be manually positioned over a bolt or pipe and thus is still very laborious. Furthermore, bolts and pipes must first be secured in order to receive the device.

To this end, a need has long existed for an improved apparatus for cleaning cylindrical objects, such as bolts and pipes, in an efficient and economical manner. It is to such an improved apparatus that the present invention is directed.

BRIEF SUMMARY OF THE INVENTION

The present invention is directed to a brush apparatus for cleaning cylindrical objects, such as pipes and bolts. The apparatus includes a support frame, a plurality of shafts rotatably mounted to the support frame, and a circular brush secured to a portion of each shaft. The brushes are arranged in a coplanar relationship and spaced apart to define an object receiving passage wherein each of the brushes engages the object when the object is disposed in the object receiving passage. The apparatus further includes means for simultaneously rotating each of the shafts so as to cause each of the brushes to rotate in the same direction and means for feeding an object into the object receiving passage so as to allow the object to rotate in response to the rotation of the brushes.

In another aspect, the present invention is directed to a method of cleaning a cylindrical object. Broadly, the method includes the steps of (a) arranging at least three circular brushes in a coplanar relationship and spaced apart to define an object receiving passage wherein each of the brushes is engagable with the object when the object is disposed in the object receiving passage; (b) causing the brushes to simultaneously rotate in the same direction; and (c) feeding the object into the object receiving passage defined by the brushes so as to engage each of the brushes.

The objects, features and advantages of the present invention will become apparent from the following detailed description when read in conjunction with the accompanying drawings and appended claims.

DETAILED DESCRIPTION OF THE INVENTION

Figure 1:
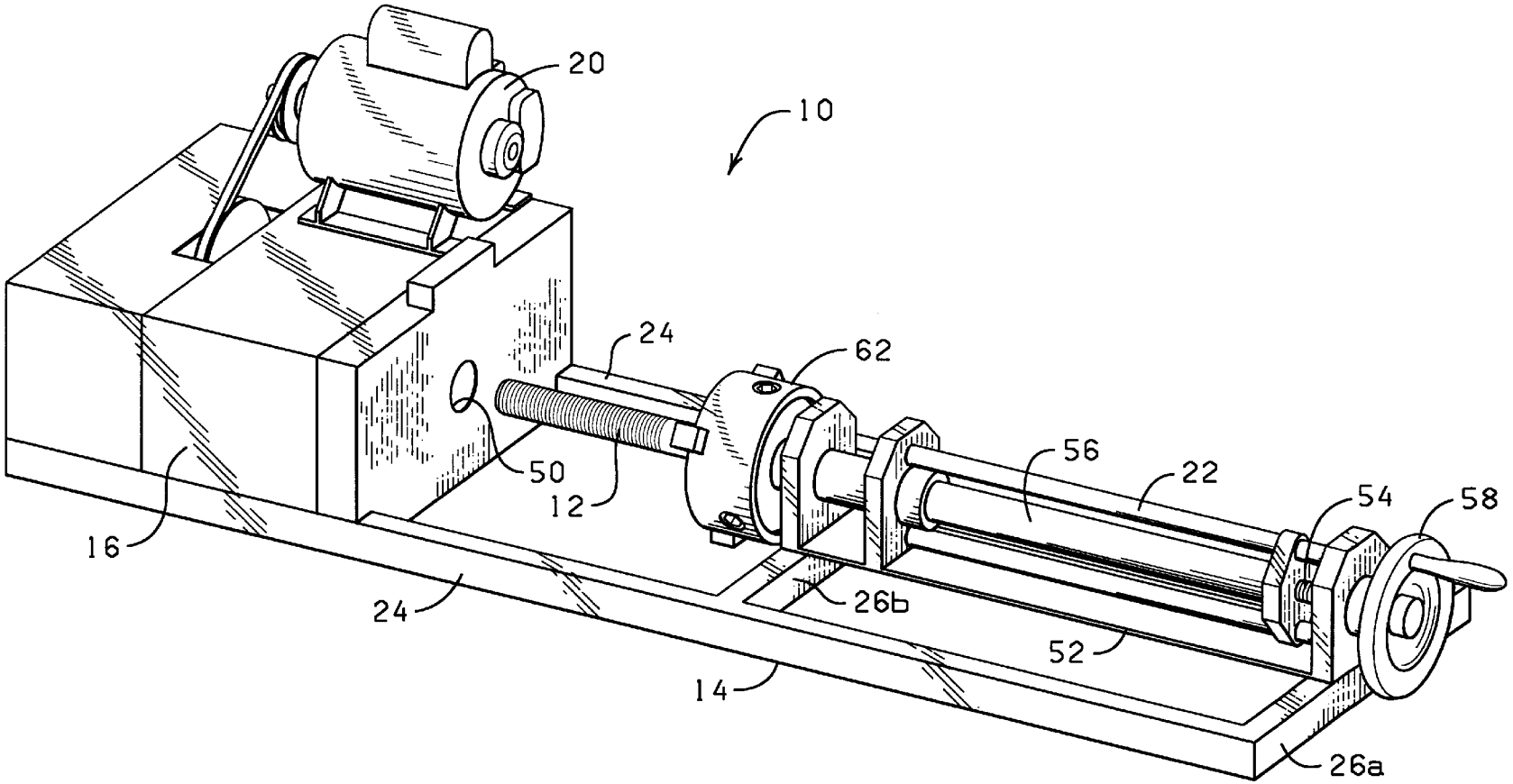
FIG. 1 is a front perspective view of a brush apparatus constructed in accordance with the present invention shown with a bolt secured thereto for cleaning.
Figure 2:
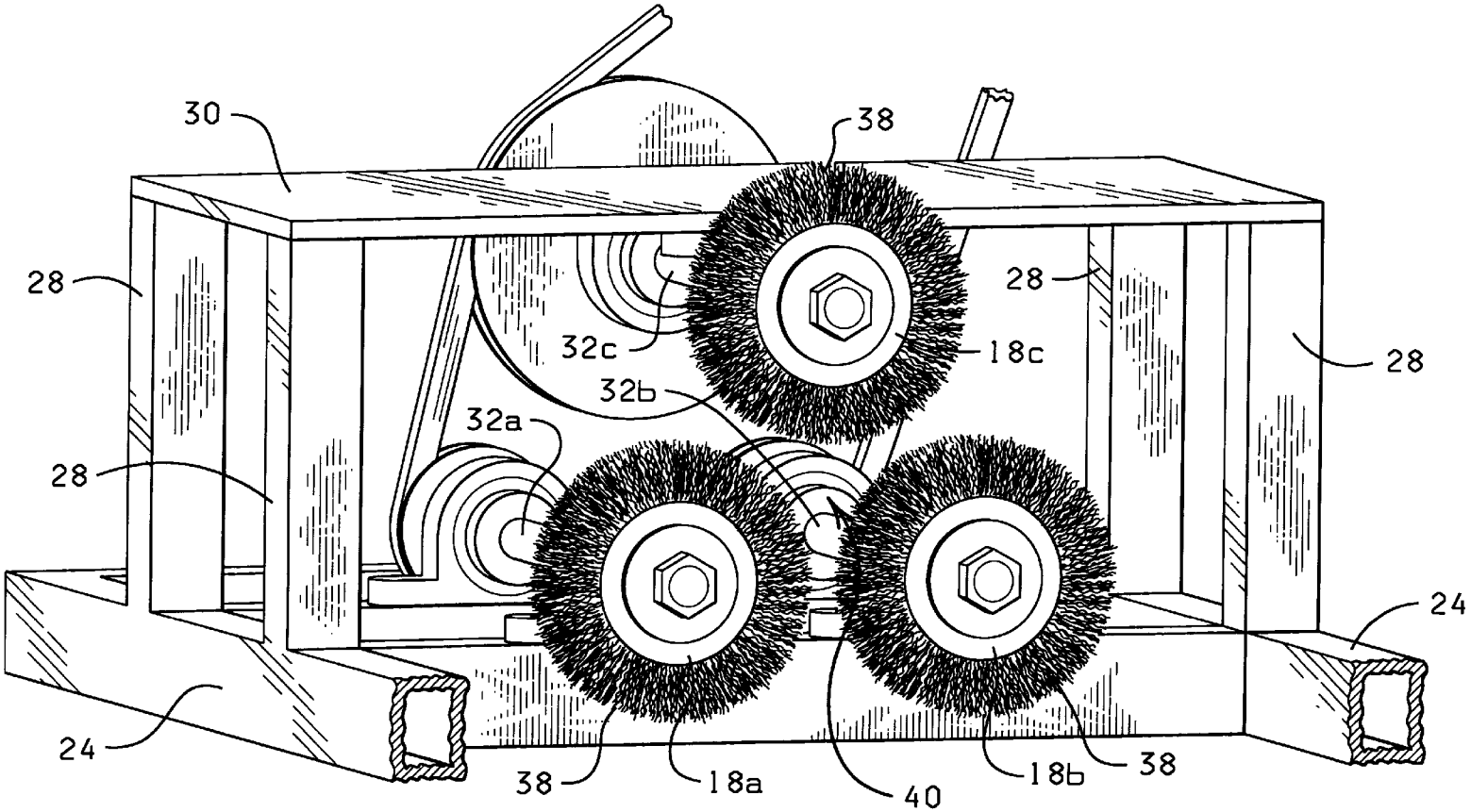
FIG. 2 is a partial perspective view of the brush apparatus of FIG. 1 shown with the housing removed for clarity.
Figure 3:
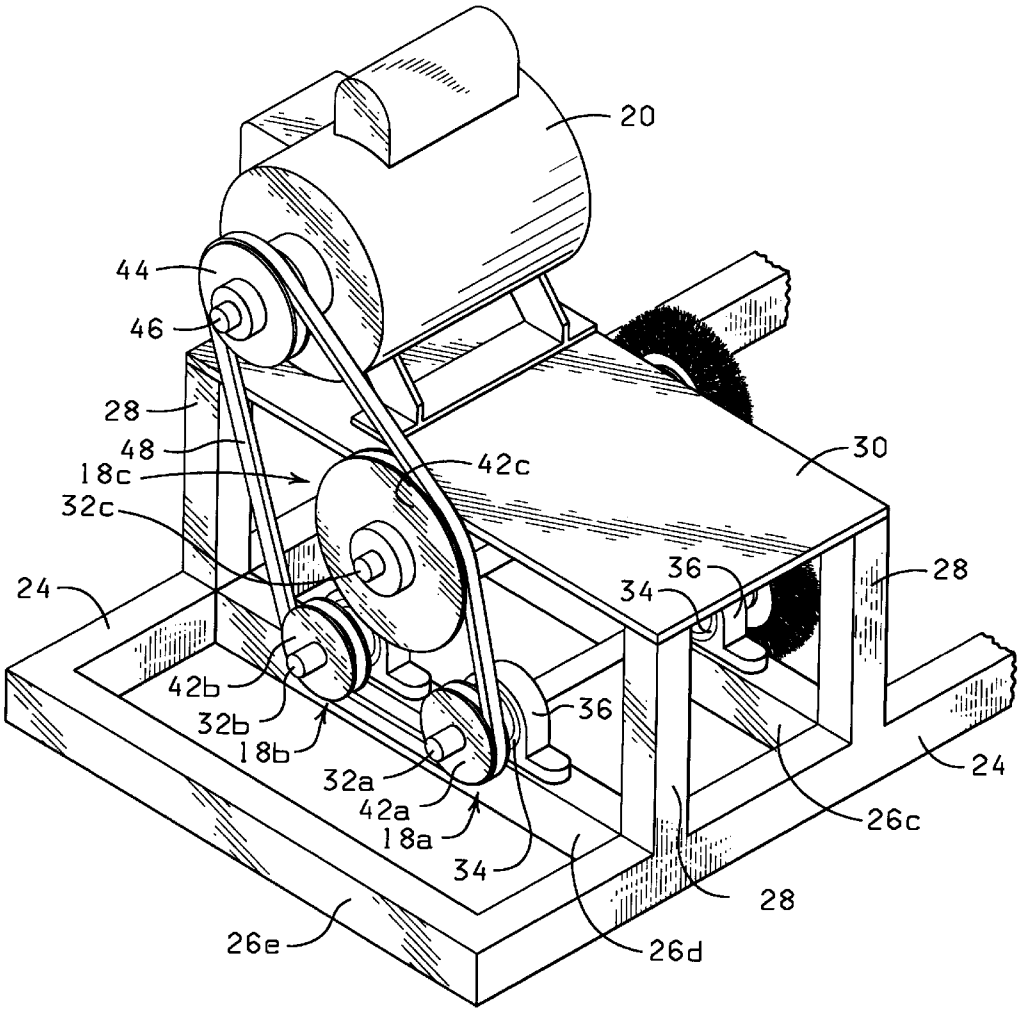
FIG. 3 is a rear perspective view of the brush apparatus of FIG. 1 shown with the housing removed for clarity.

Referring now to the drawings and more particularly to FIGS. 1–3, a brush apparatus 10 constructed in accordance with the present invention is shown with a bolt 12 secured thereto. The brush apparatus 10 includes a frame 14, a housing 16 (FIG. 1), a plurality of brush assemblies 18*a*–18*c* (FIGS. 2 and 3), a motor 20 (FIGS. 1 and 3), and an object feed mechanism 22 (FIG. 1).

The frame 14 includes a pair of longitudinal support members 24 spaced apart in a parallel relationship by a plurality of cross members 26*a*–26*e* (26*a*–26*b* shown in FIG. 1 and 26*c*–26*e* shown in FIG. 3). The frame 14 further includes a plurality of vertical support members 28 (FIGS. 2 and 3) extending upward from the support members 24 and a support plate 30 (FIGS. 2 and 3) supported by the vertical support members 28.

Each of the brush assemblies 18*a*–18*c* includes a shaft 32*a*–32*c*, respectively, rotatably secured to the frame 14 with a pair of shaft bearings 34 (FIG. 3) which are in turn mounted within a pillar block 36 (FIG. 3). More specifically, the shafts 32*a* and 32*b* are mounted to the cross members 26*c* and 26*d*, and the shaft 32*c* is mounted to the lower side of the support plate 30.

Each brush assembly 18*a*–18*c* further includes a circular brush 38 (FIG. 2) secured to one end of each of the shafts 32*a*–32*c* so that each of the brushes 38 are arranged in a coplanar relationship to one another and spaced apart to define an object receiving passage 40. The brushes 38 are conventional cylindrical brushes fashioned of any metallic or other flexible bristle material suitable for cleaning metallic objects. It will be appreciated that the brushes 38 are spaced apart so that the brushes 38 engage an object, such as the bolt 12, when the object is positioned in the object receiving passage 40. It will further be appreciated, therefore, though not shown herein, that the shafts 32*a*–32*c* can be adjustably secured to the frame 14 to permit the spacing between the brushes 38 to be selectively altered to accommodate objects of various sizes.

Each brush assembly 18*a*–18*c* further includes a pulley 42*a*–42*c*, respectively. Pulleys 42*a*–42*c* are secured to the shafts 32*a*–32*c*, substantially as shown in FIG. 3. Pulleys 42*a*–42*c* are connected to a pulley 44 which is mounted on a shaft 46 of the motor 20 by a belt 48. The motor 20 is preferably a one horse power motor; however, any motor or device for driving the belt 48 can be used.

While it is desirable that the brushes 38 be rotated in the same direction, it is preferable that one of the brushes 38 be rotated at a different speed than the other brushes 38 in order to avoid the brushes merely rotating or spinning the object disposed in the object receiving passage 40 without the brushes 38 passing across the outer surface of the object so as to remove foreign matter disposed thereon. To this end, as best shown in FIG. 3, the pulley 42*c* has a greater diameter than the pulleys 42*a* and 42*b*. As such, the pulley 42*c* will be caused to rotate at a slower rate than the pulleys 42*a* and 42*b* and thus the brush 38*c* will rotate at a slower rate than the brushes 38*a* and 38*b*.

To prevent debris from being thrown by the brushes 38, the brush assemblies 18 are encased in the housing 16 (FIG. 1). The housing 16 is secured to the frame 14 and is provided with an opening 50 which is substantially aligned with the object receiving passage 40 defined by the brushes 38 to permit an object to be inserted into the object receiving passage 40.

Figure 4:
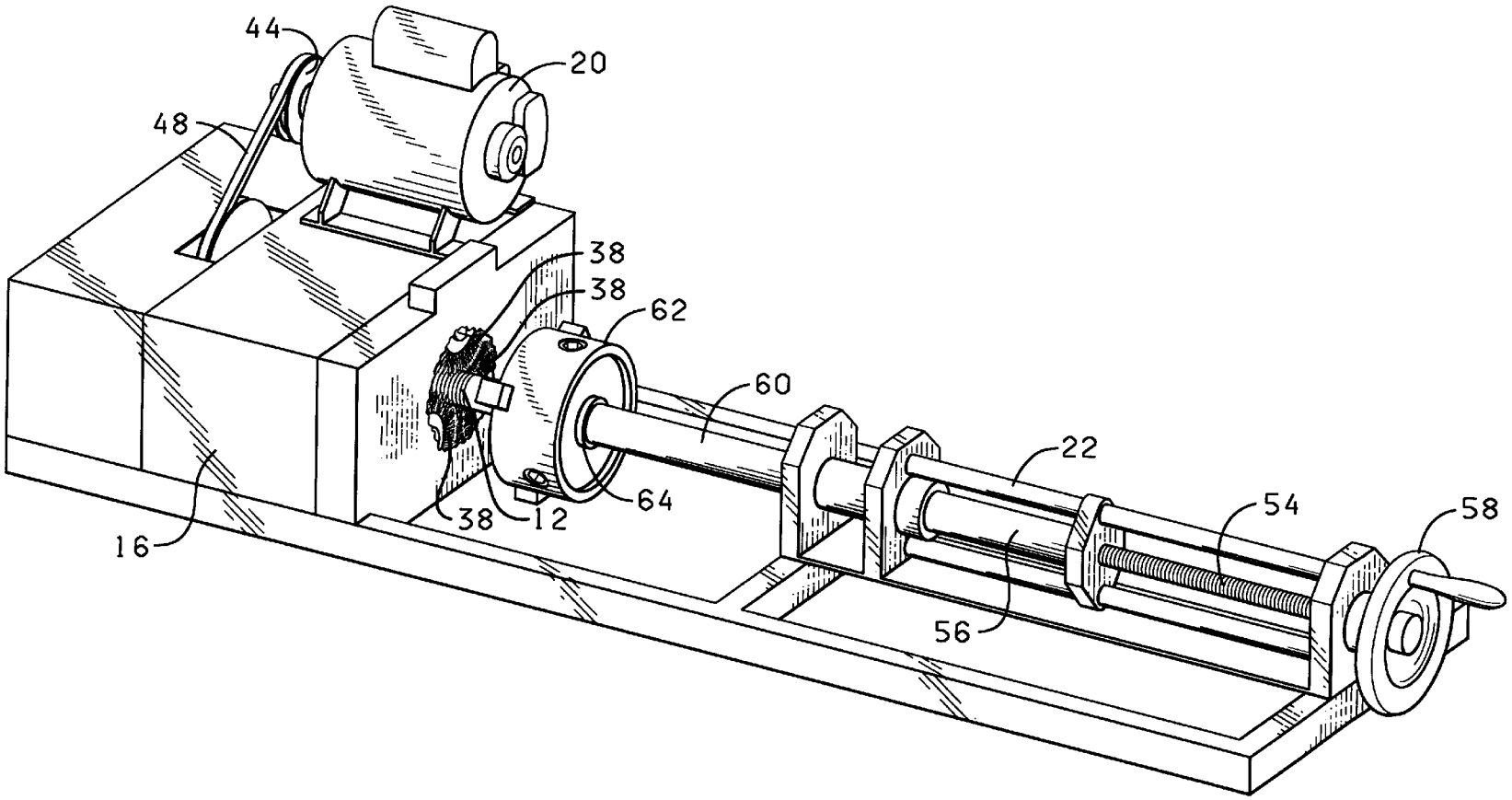
FIG. 4 is a perspective view of the brush apparatus of FIG. 2 shown in operation with the bolt positioned between the brushes.

Referring to FIGS. 1 and 4, the object feed mechanism 22 is secured to the cross members 26*a* and 26*b* of the frame 14 to facilitate inserting a cylindrical object into the object receiving passage 40 and thus into engagement with the brushes 38. The object feed mechanism 22 includes a frame 52, a ball screw 54 which is adapted to reciprocally move a cylinder 56 in response to rotation of the ball screw 54 with a hand wheel 58. One end of a shaft 60 (FIG. 4) is connected, to the cylinder 56 while a chuck 62 is connected to the other end of the shaft 60. The chuck 62 is adapted to hold a cylindrical object such as the bolt 12 or a piece of pipe. The chuck 62 is rotatably attached to the shaft 60 by a shaft bearing 64 (FIG. 4) so that the object is able to rotate in response to engagement with the rotating brushes 38. It will be appreciated that the chuck 62 should rotate at a slower rate than the brushes 38 to effectively clean the object and that the feed mechanism 22 can be equipped with a mechanical means for rotating the chuck 62 at a desirable rate. For example, the feed mechanism 22 can include a gear and clutch assembly (not shown) or the like.

It will be understood that other types of mechanisms can be utilized to feed an object into the object receiving passage 40 other than that shown herein. For example, a pneumatic or hydraulic cylinder can be used in place of the ball screw and cylinder arrangement disclosed above. In addition, a hand held device could be used which requires an individual to advance the object into the object receiving passage 40.

In use, an object, such as the bolt 12, is secured in the chuck 62 of the object feed mechanism 22 (FIG. 1). The motor 20 is then activated thereby causing the pulley 44 to drive the belt 48 so as to cause the shafts 32*a*–32*c*, and thus the brushes 38, to simultaneously rotate in the same direction (counterclockwise, for example). The hand wheel 58 is then rotated so as to rotate the ball screw 54 so as to cause the cylinder 56, the shaft 60, and the chuck 62, and in turn, the bolt 12 to be advanced toward the opening 50 of the housing 16. The bolt 12 is gradually fed into the object receiving passage 40 so as to engage each of the brushes 38, as shown in FIG. 4. Due to the variable rotation rate of the brushes 38 and the rotational connection of the chuck 62 to the shaft 60, the object is caused to rotate in response to the rotation of the brushes 38, thereby resulting in the brushes 38 coming into contact with the entire circumferential surface of the object. The object is continually fed into the object receiving passage 40 until the object is cleaned along a desired length thereof. Upon completion of the cleaning of the object, the object is withdrawn from the object receiving passage 40 by reversing the rotation of the ball screw 54 with the hand wheel 58. To clean the other end of the object, the object is removed from the chuck 62, rotated 180 degrees, and then the other end of the object is secured in the chuck 62. The process described above is then repeated.

The cleaning apparatus 10 can be modified to include a vacuum system (not shown) for removing the debris brushed from the object.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. An apparatus for cleaning a cylindrical object, comprising:

a support frame;

at least three shafts rotatably mounted to the support frame;

a circular brush secured to a portion of each shaft such that the brushes are spaced apart to define an object receiving passage wherein each of the brushes engages the object when the object is disposed in the object receiving passage;

means for simultaneously rotating each of the shafts so as to cause each of the brushes to rotate; and means for reciprocally feeding the object into the object receiving passage and for rotating the object relative to the rotating brushes.

2. The apparatus of claim 1 wherein the brushes are arranged in a coplanar relationship.

3. The apparatus of claim 1 wherein one of the brushes is caused to rotate at a different rate than the other brushes.

4. The apparatus of claim 3 further comprising a housing sized to substantially encompass the shafts and the brushes, the housing having an opening substantially aligned with the object receiving passage defined by the brushes.

5. The apparatus of claim 1 wherein the means for feeding causes the object to rotate at a rate less that the rate of rotation of the brushes.

6. An apparatus for cleaning a cylindrical object, comprising:

a support frame;

at least three shafts rotatably mounted to the support frame;

a rotary brush secured to a portion of each shaft such that the brushes are arranged in a coplanar relationship and spaced apart to define an object receiving passage wherein each of the brushes engages the object when the object is disposed in the object receiving passage;

means for simultaneously rotating each of the shafts so as to cause each of the brushes to rotate in the same direction but with at least one of the brushes rotating at a different rate than the other brushes; and means for reciprocally feeding the object into the object receiving passage and for rotating the object relative to the rotating brushes.

7. The apparatus of claim 6 further comprising a housing sized to substantially encompass the shafts and the brushes, the housing having an opening substantially aligned with the object receiving passage defined by the brushes.

* * * * *